US009139971B2

(12) United States Patent
Parker

(10) Patent No.: US 9,139,971 B2
(45) Date of Patent: Sep. 22, 2015

(54) AGGREGATE REPLACEMENT

(71) Applicant: Alton F. Parker, Clifton Park, NY (US)

(72) Inventor: Alton F. Parker, Clifton Park, NY (US)

( * ) Notice: Subject to any disclaimer, the term of this patent is extended or adjusted under 35 U.S.C. 154(b) by 90 days.

(21) Appl. No.: 13/851,004

(22) Filed: Mar. 26, 2013

(65) Prior Publication Data

US 2014/0294507 A1 Oct. 2, 2014

(51) Int. Cl.
*E02B 11/00* (2006.01)

(52) U.S. Cl.
CPC ..... *E02B 11/005* (2013.01)

(58) Field of Classification Search
CPC ..... E02B 11/00; E02B 11/005
USPC ..... 405/43, 45, 50, 184.4, 46
See application file for complete search history.

(56) References Cited

U.S. PATENT DOCUMENTS 4,183,484 A * 1/1980 Mathews ..... 405/184.4
4,192,628 A * 3/1980 Gorman ..... 405/45
4,588,325 A * 5/1986 Seefert ..... 405/46
4,909,665 A 3/1990 Caouette
4,982,533 A 1/1991 Florence
4,983,069 A 1/1991 Florence
5,051,028 A 9/1991 Houck et al.
5,437,424 A * 8/1995 Netz, Sr. ..... 405/184.4
5,553,975 A * 9/1996 Elkins ..... 405/184.4
5,605,419 A * 2/1997 Reinert, Sr. ..... 405/184.4
5,639,364 A * 6/1997 Houck et al. ..... 405/50
5,810,509 A 9/1998 Nahlik, Jr.
5,810,510 A 9/1998 Urriola
6,095,718 A 8/2000 Bohnhoff
6,428,870 B1 * 8/2002 Bohnhoff ..... 405/50
6,602,023 B2 8/2003 Crescenzi et al.
6,648,549 B1 * 11/2003 Urriola ..... 405/45
6,779,946 B1 * 8/2004 Urriola et al. ..... 405/43
7,191,802 B2 3/2007 Koerner
7,207,747 B1 4/2007 England
7,413,381 B1 8/2008 Bracone, Jr.
7,517,172 B2 4/2009 Sipaila
7,591,610 B2 * 9/2009 Krichten et al. ..... 405/50
7,621,695 B2 * 11/2009 Smith et al. ..... 405/43
7,677,835 B2 3/2010 Oscar
7,712,997 B2 * 5/2010 Roelfsema ..... 405/45
7,909,535 B2 3/2011 Samara
7,942,371 B1 * 5/2011 McCoy ..... 248/68.1
2009/0080976 A1 3/2009 Anderlind et al.

(Continued)

OTHER PUBLICATIONS

French drain, Wikipedia, last edited on Mar. 18, 2014: http://en.wikipedia.org/wiki/French_drain.

(Continued)

*Primary Examiner* — Frederick L Lagman
(74) *Attorney, Agent, or Firm* — Schmeiser, Olsen & Watts LLP

(57) ABSTRACT

An aggregate replacement device may be used to take replace rock aggregate in underground drainage systems. An aggregate replacement device may include a structure having a proximal end, a distal end, and at least one face. The at least one face may have a plurality of first openings. A second opening in the structure may extend from the proximal end to the distal end of the structure continuing uninterrupted through at least one of the at least one faces. The second opening may receive a pipe inserted in a radial direction of the pipe. The aggregate replacement device may also include a pipe retainer. An additional embodiment of the aggregate replacement device may include a stake which may be used to secure the aggregate replacement device in position.

15 Claims, 8 Drawing Sheets

(56) References Cited

U.S. PATENT DOCUMENTS

| | | | | |
|---|---|---|---|---|
| 2009/0279953 | A1* | 11/2009 | Allard et al. | 405/45 |
| 2010/0021236 | A1* | 1/2010 | Kreikemeier | 405/55 |
| 2010/0189514 | A1* | 7/2010 | Gunn et al. | 405/172 |
| 2011/0204529 | A1* | 8/2011 | Kerkhoff et al. | 261/30 |

OTHER PUBLICATIONS

Polypipe Polystorm Soakaway Crate, Drainageonline.co.uk, Accessed on May 19, 2014: http://www.drainageonline.co.uk/Soakaway-%26-Geotextiles/Polystorm-Soakaway-Crate.htm.

Soakaways, www.DrainageSales.com, Accessed on May 19, 2014: http://www.drainagepipe.co.uk/products/soakaways-155/.

Rainwater Harvesting Underground Water Tank (Re-use Tank), www.atlantiscorp.com.au, Accessed on May 19, 2014: http://www.atlantiscorp.com.au/solutions/landscaping/rainwater-harvesting.

Atlantis 30mm Flo-Cell@ The Orginal Drainage Cell, www.drainagecell.com, Accessed on May 19, 2014: http://www.drainagecell.com/30mmflocell.html.

EZ Flow French Drain, www.ndspro.com, Accessed on May 20, 2014: http://www.ndspro.com/image-library/french-drains/ezflow-french-drain-gallery.

French Drains, www.MapleValleyTractorServices.com, Accessed on May 20, 2014: http://www.maplevalleytractorservices.com/id64.html.

French Drains, Ditches, and Swales; www.maggiesfarm.anotherdotcom.com, Accessed on May 20, 2014: http://maggiesfarm.anotherdotcom.com/archives/13979-French-Drains,-Ditches,-and-Swales.html.

All About French Drains, www.lisklandscape.com, Accessed on May 20, 2014: http://www.lisklandscape.com/landscaping-ideas/how-to-install-a-french-drain/.

Classic Drainage, Inc.; www.classicdrainage.com, Accessed on May 20, 2014: http://classicdrainage.com/.

Homeowner's Newsletter, www.homeinspectionnewsletter.blogspot.com, Accessed on May 20, 2014: http://homeinspection-newsletter.blogspot.com/2009/06/water-problems-and-solutions-under-your.html.

How to dig and install a French Drain to collect and move rain water away from your home, www.easydigging.com, Accessed on May 20, 2014: http://www.easydigging.com/Drainage/installation_french_drain.html.

Form-a-Drain, www.nitterhousemasonry.com, Accessed on May 20, 2014: http://www.nitterhousemasonry.com/products/form-a-drain/.

Polypipe Building Products, www.polypipe.com, Accessed on May 20, 2014: http://www.polypipe.com/building-products/.

* cited by examiner

AGGREGATE REPLACEMENT

BACKGROUND OF THE INVENTION

1. Technical Field

This invention relates to French drains and in particular to a device which can be used to replace the aggregate used in French drains or other water distribution systems.

2. Background Art

French drains are widely used in residential and commercial building applications to collect groundwater and distribute it away from the proximity of basements, foundations, footings, and similar surface and subterranean building structures where water may penetrate and/or damage these structures. An additional use of this technology is to deliver water into the sub-surface of the ground. For example, a French drain may be used to distribute fluid into the drain field of a residential septic system.

Various structures have been developed over the last two hundred years to accomplish this diversion of fluids. Generally, they consist of a pipe containing multiple small perforations throughout its sidewall through which water or fluid enters the pipe. The fluid then travels down the pipe to a desired location. To keep the perforations in the pipe from clogging, and to prevent dirt or other material from the surrounding substrate from entering the pipe, the pipe is laid within a bed of solid granular material that creates a porous aggregate unrestrictive to the flow of fluid, such as gravel, or a similar synthetic aggregate. Finally, a woven, coarse, landscape textile or filter fabric is used to surround and cover the aggregate to prevent the aggregate from becoming clogged with dirt or other surrounding substrate. The pipe, surrounding aggregate, and textile are typically installed within a trench which is then filled to grade level with dirt or other substrate. Rainwater or other surface water in the area seeps from the surrounding substrate through the textile where it may trickle freely through the aggregate into the pipe for removal from the area.

One significant problem with this system is the labor and expense necessary to surround the pipe with the aggregate. Also, if the aggregate is too heavy or is not placed carefully on top of the pipe, the pipe may break or collapse while the aggregate is being placed. This can cause time consuming and expensive problems.

Various inventions have been made in order to try and prevent these problems. For example, U.S. Pat. No. 5,810,509 issued to Nahlik, Jr. discloses a cell system for buried drainage pipes. These cells, however, cannot be used to form continuous French drains. Instead, there are individual cells that are spaced throughout the drainage area. These cells also do not protect the areas of pipe between the cells and therefore there may be a problem with these areas of pipe being damaged when the trench they are laid in is filled.

U.S. Pat. No. 7,191,802 issued to Koerner (hereinafter "Koerner") and U.S. Pat. No. 5,051,028 issued to Houck et al. (hereinafter "Houck"), also attempt to improve French drains by replacing the standard aggregate. They, however, do not allow the aggregate replacement and pipe to be easily assembled on site.

Instead Houck discloses units that are manufactured as one piece with sections of perforated pipe inside. Multiple units are hooked together. Therefore if a section of pipe becomes damaged, the entire unit must be replaced rather than just the pipe.

Koerner discloses a system where netting filled with aggregate is wrapped along a perforated pipe. This system takes too long to conveniently assemble on site and therefore will likely need to be preassembled. Therefore if the pipe gets damaged the entire assembly will need to be replaced rather than simply replacing the pipe.

Also, while these patents claim to protect the pipe, in reality they would provide very little protection to the pipe when the trench is being filled in with substrate.

Accordingly, what is needed is an aggregate replacement device that is light weight, easy to use, quick to install and which allows the pipe to be accessed and inserted after the aggregate replacement has been placed in the trench.

DISCLOSURE OF THE INVENTION

The aggregate replacement device, as disclosed hereafter in this application, is strong, lightweight and easy to assemble.

In particular embodiments, an aggregate replacement device includes a structure with a proximal end, a distal end, and at least one face wherein the at least one face includes a plurality of first openings. A second opening in the structure extends from the proximal end to the distal end continuing uninterrupted through at least one of the at least one faces. The second opening is configured to receive at least one pipe inserted in a radial direction of the at least one pipe.

Additional embodiments of an aggregate replacement device may include a structure having a proximal end, a distal end, and at least one face that is water permeable. The aggregate replacement device may also include an opening in the at least one outer face that extends from the proximal end to the distal end of the structure continuously. The opening may be configured to receive at least one pipe inserted in a radial direction of the at least one pipe. The opening may further include at least one pipe retainer.

Other embodiments of an aggregate replacement device may include a structure having a proximal end, a distal end, and at least two faces. The at least two faces further contain a plurality of first openings. A stake may be coupled to the structure to secure the structure in a desired position. A concrete barrier may be placed abutting at least one of the at least two faces. An second opening in the structure may extend from the proximal end of the structure to the distal end of the structure continuing uninterrupted through at least one of the at least two faces. The second opening, however, continues through a different at least one of the at least two faces than the concrete barrier abuts. The second opening may be configured to receive at least one pipe inserted in a radial direction of the at least one pipe.

The foregoing and other features and advantages of the aggregate replacement device will be apparent to those of ordinary skill in the art from the following more particular description of the invention and the accompanying drawings.

BRIEF DESCRIPTION OF THE DRAWINGS

The invention will hereinafter be described in conjunction with the appended drawings where like designations denote like elements, and.

DESCRIPTION OF THE INVENTION

Figure 1:
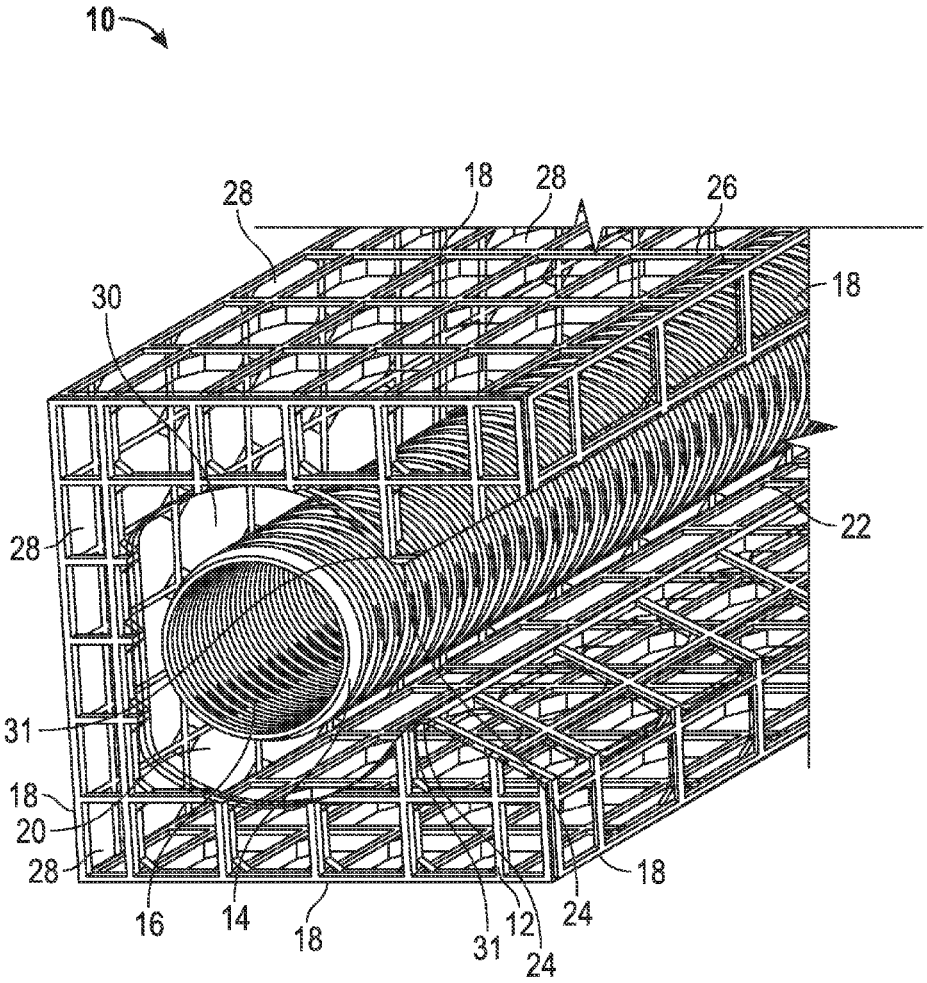
FIG. 1 is an isometric view of an aggregate replacement configured according to a first embodiment.

As discussed above, embodiments of the present invention relate to an aggregate replacement device for use in French drains and the like. In particular, disclosed is an aggregate replacement device including a structure with fluid permeable surfaces, and an opening configured to receive a pipe inserted parallel to a diameter of the pipe.

When French drains or other drainage or fluid distribution systems are set up, a trench is dug in the ground in the area where the water is to be drained from. The trench is then lined with a landscape, filter fabric or other water permeable material which prevents the soil or substrate from the surrounding area from entering the trench. Aggregate may then be placed in the bottom of the trench. This aggregate is typically washed gravel or a synthetic aggregate that allows water to flow freely through. A perforated pipe is then placed on top of the aggregate. The perforated pipe could also be placed directly on the filter fabric in the bottom of the trench. The perforated pipe is then covered with additional aggregate. The top of the additional aggregate may have more filter fabric placed on it. Then top soil and plants may be placed on the filter fabric hiding the French drain underground.

FIGS. 1-6 illustrate an aggregate replacement 10 configured according to embodiments of the present invention. The aggregate replacement 10 takes the place of the washed gravel or synthetic aggregate in a French drain or other water distribution system.

The aggregate replacement 10 includes a structure 26 which is formed as an open scaffolding. The structure 26 includes a proximal end 12, a distal end 32 and at least one face 18. The proximal end 12 is coupled to the at least one face 18. In the figures, the proximal end 12 is coupled at a 90 degree angle to four faces 18. The four faces 18 illustrated are rectangular or square. It is anticipated, however, that only one face 18 could be used. This face 18 would be curved in order to form a cylindrical aggregate replacement. It is also anticipated that three faces 18 could be utilized in order to form a structure with a triangular cross section. A plurality of faces 18 greater than four could also be used to form the structure 26. The number of faces 18 and the desired shape of the structure 26 will determine the angle at which the faces are coupled to the proximal end 12. The four faces 18, shown in the figures, are also coupled to each other at 90 degree angles. The angle at which the faces 18 are coupled to each other will vary depending on the number and shape of faces 18 utilized. The distal end 32 is coupled to the remaining open edges of the four faces 18. The arrangement described and depicted in the figures results in a cube or rectangular prism shaped structure 26. However, the structure 26 may be any type of shape desired. The at least one face 18, proximal end 12, and distal end 32 may also be formed in any shape desired.

In additional embodiments, the structure 26 may be curved in order to form circular, serpentine or other irregularly shaped drains.

The structure 26 forms a mostly hollow interior 20. The mostly hollow interior 20 may contain supports or other devices necessary to strengthen the structure 26. However, these devices should not impede the flow of water in the interior 20 of the structure 26. The mostly hollow interior 20 of the structure 26 allows water to drain through the structure 26 just like water would drain through the washed gravel or synthetic aggregate of traditional drains.

Figure 2:
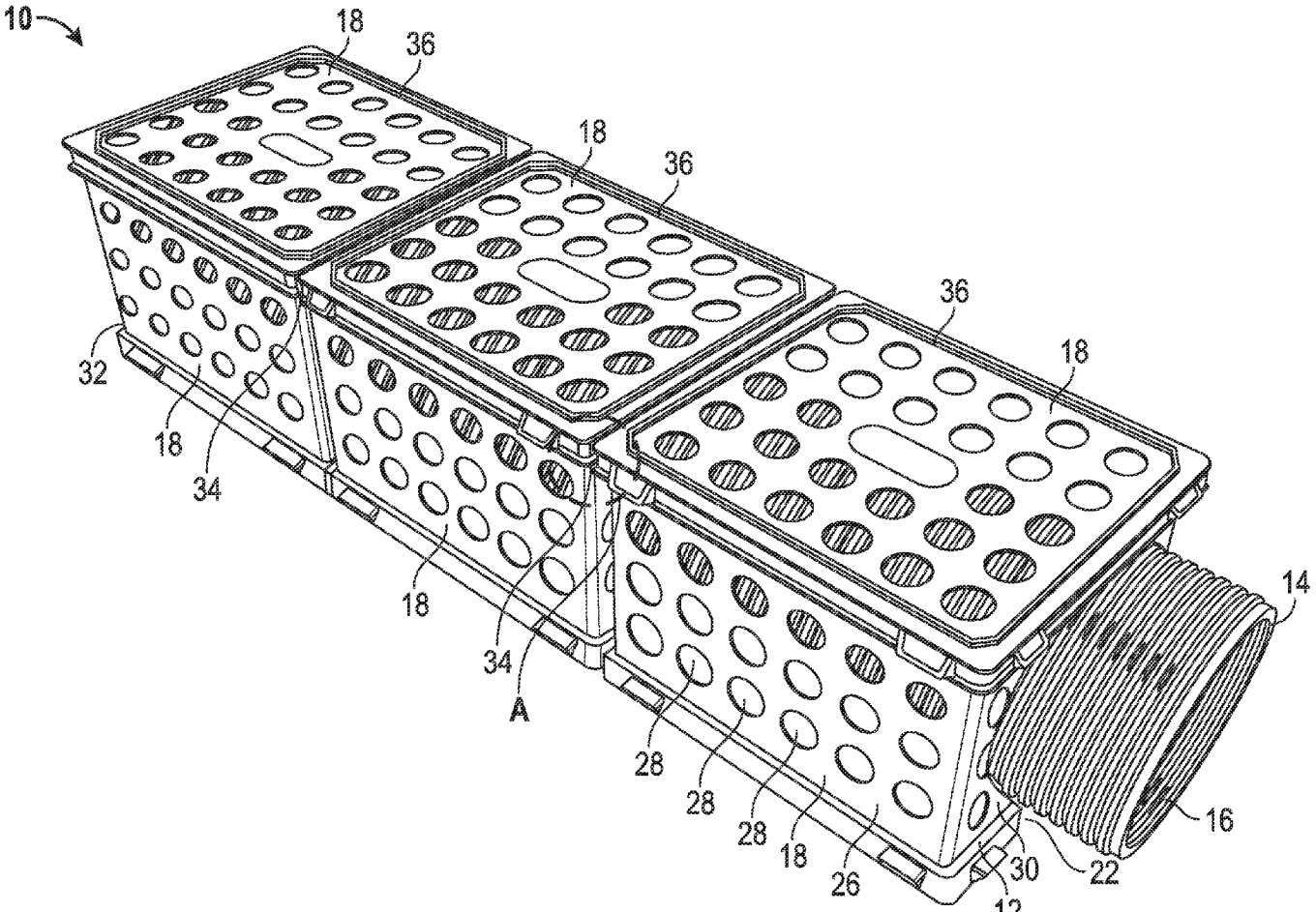
FIG. 2 is an isometric view of an aggregate replacement configured according to a second embodiment.
Figure 3:
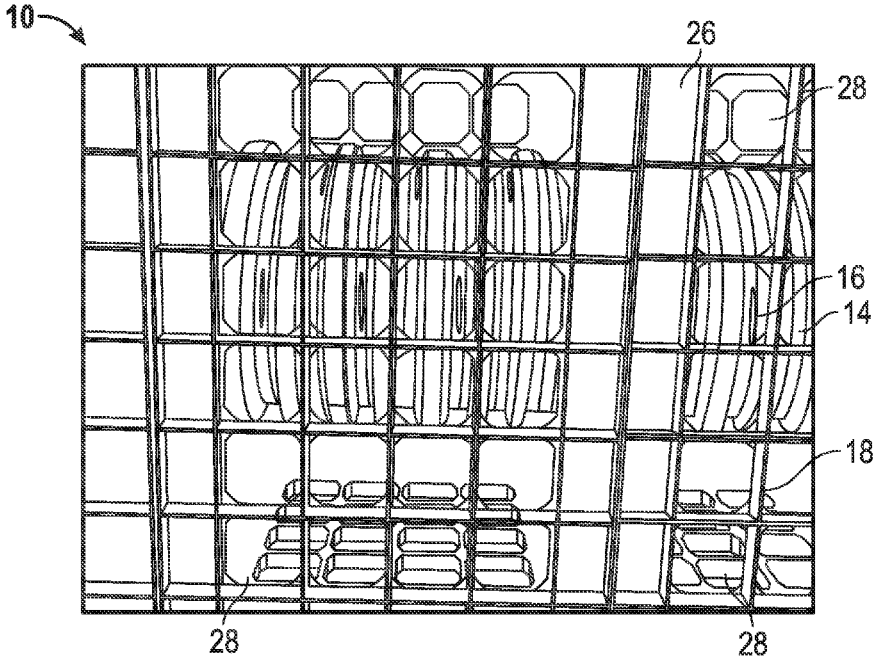
FIG. 3 is a first side view of an aggregate replacement configured according to the embodiments of FIG. 1.
Figure 4:
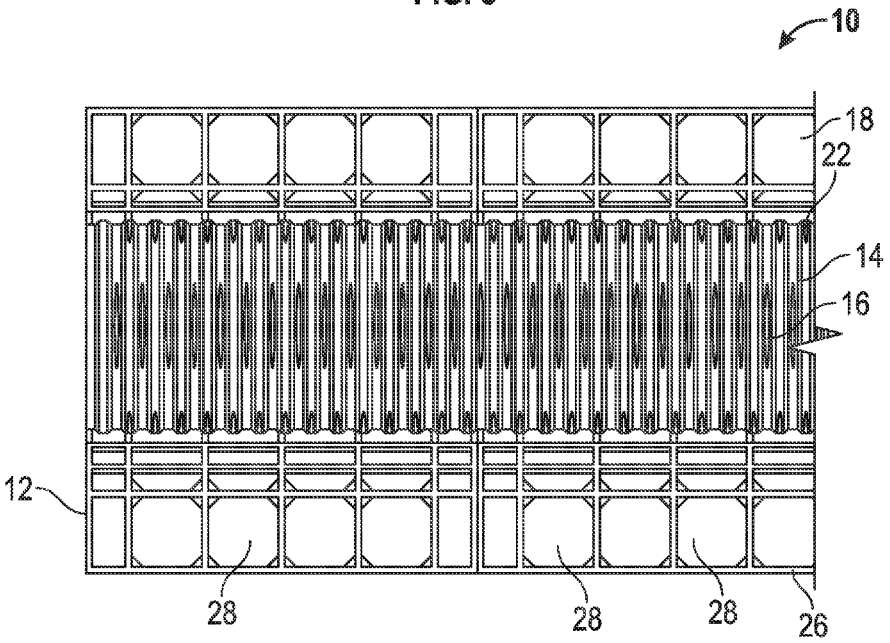
FIG. 4 is a second side view of an aggregate replacement configured according to the embodiments of FIG. 1.

The proximal end 12, distal end 32 and at least one face 18 are water permeable. This is accomplished by forming at least one first opening 28 in the proximal end 12, distal end 32 and at least one face 18. In FIG. 1, the proximal end 12, distal end 32 and four faces 18 are all formed with multiple square openings 28 separated by thin structural members which help structure 26 maintain its shape while allowing fluid, typically water, to pass easily through the proximal end 12, distal end 32 and faces 18. FIG. 2 has multiple round openings 28 in the proximal end 12, distal end 32 and at least one face 18. The at least one first opening 28 may be any size or shape desired so long as the openings 28 are a size and shape that allow water to easily permeate the surfaces of the structure 26 and enter the mostly hollow interior 20.

It alternate embodiments, the proximal end 12, the distal end 32 of the structure 26 and at least one but not all of the faces 18 may not contain any openings 28.

Figure 11:
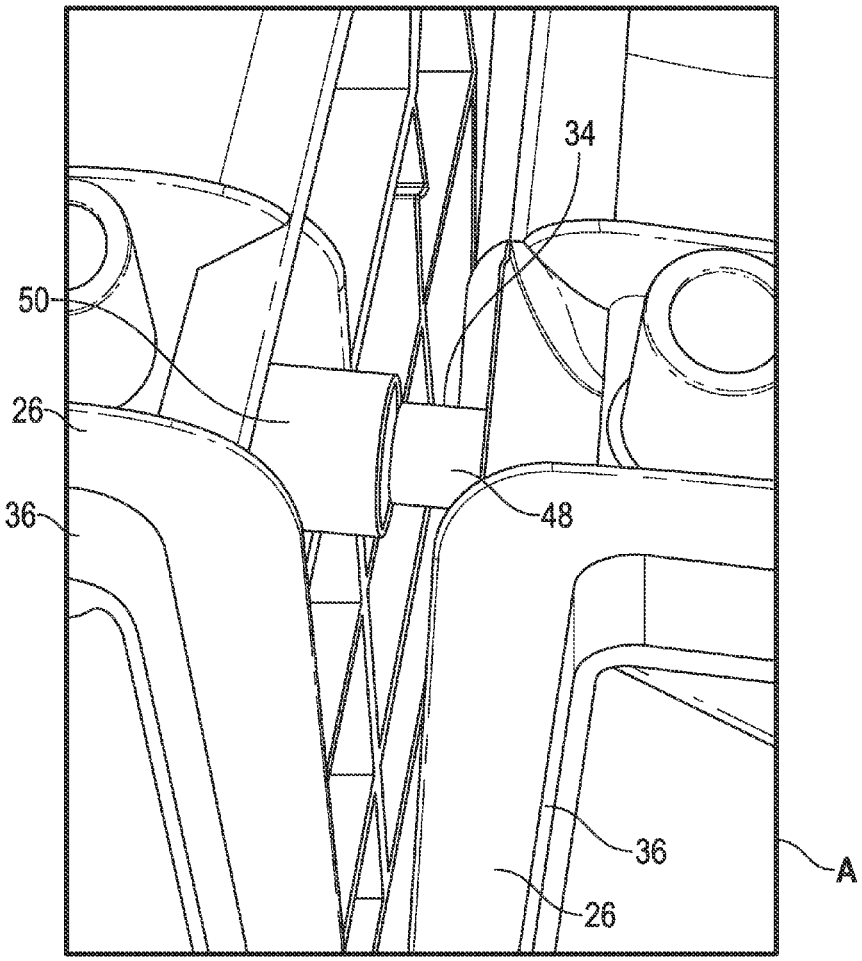
FIG. 11 is a close up view of an area denoted by A in FIG. 2.

The aggregate replacement 10 may be formed as one single piece that runs the entire length of the drain or it may be formed in smaller pieces that are connected together. FIG. 2 illustrates an embodiment of an aggregate replacement 10 which is composed of multiple units 36 which are coupled together with connectors 34. These connectors 34 may be any type of connector that holds two aggregate replacement units 36 together. FIG. 11 is a close up of section A from FIG. 2. FIG. 11 shows a connector 34. In this illustration, the connector is a pin 48 which slides into a receiver 50. The pin 48 is simply a cylindrical extension from the structure 26 of the aggregate replacement 10. The receiver 50 is an open cylindrical extension of the structure 26 of the aggregate replacement 10. The pin and the receiver are close enough in size that by inserting the pin 48 into the receiver 50, the units 36 are kept reasonably securely connected.

In alternate embodiments, the connector 34 may be flexible in order to allow the units 36 to be connected in a circular, serpentine, or non-linear arrangement.

In other embodiments, multiple units 36 may simply be placed adjacent each other without the use of connectors. The pipe 14 would then be inserted into the units 36. The units 36 would be held adjacent to each other by the pipe 14.

FIGS. 1-6 also show a second opening in a face 18 of the structure 26. The second opening may comprise an insertion opening 22, a pipe retainer and a pipe receiver 30. The insertion opening 22 is created in one of the at least one faces 18 of the structure 26. The insertion opening 22 allows a pipe 14 with perforations 16 to be inserted in a radial direction into the aggregate replacement 10. The insertion opening 22 should be large enough to allow a pipe 14 of a desired size to be inserted into the structure 26 of the aggregate replacement 10. The insertion opening 22 runs the entire length of one of the at least one faces 18 as shown FIG. 4 which is a side view of the aggregate replacement 10.

Figure 5:
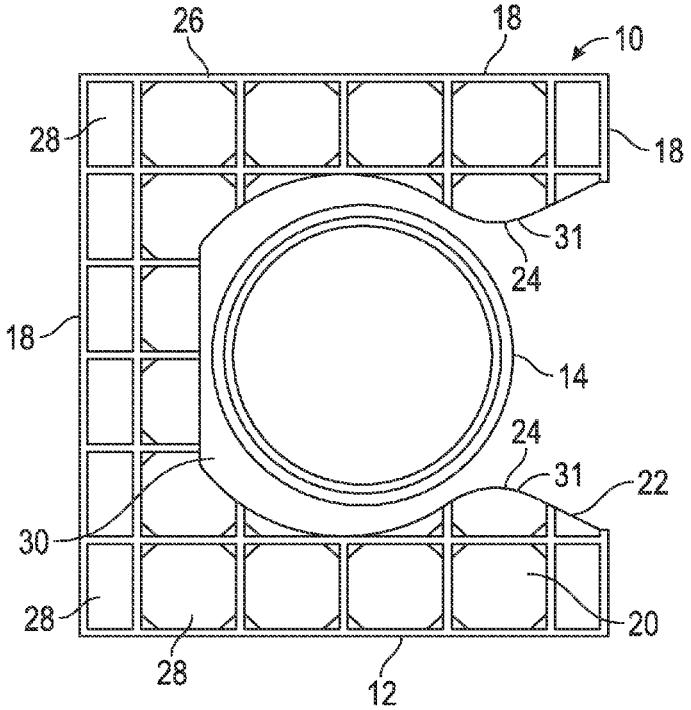
FIG. 5 is an end view of an aggregate replacement configured according to the embodiments of FIG. 1.

FIG. 5 is a view of the proximal 12 or distal end 32 of the structure 26. The insertion opening 22 also extends through the proximal end 12 and the distal end 32 of the structure 26. In the proximal end 12 and the distal end 32 of the structure, the insertion opening 22 forms a pipe receiver 30.

The pipe receiver 30 is an opening formed in the proximal end 12 and the distal end 32 of the structure 26. The pipe receiver 30 is slightly larger than the diameter of the pipe 14 and holds the pipe 14 when the drain is in place. The pipe receiver 30 has a mouth which connects to the insertion opening 22.

At the mouth 31 of the pipe receiver 30, may be a pipe retainer. The pipe retainer may comprise at least one protrusion 24. The at least one protrusion 24 narrows the insertion opening 22 to less than the diameter of the pipe 14. The at least one protrusion 24 may be flexible, or the pipe 14 may be slightly flexible in order to allow the pipe 14 to be forced past the at least one protrusion 24 and through the mouth 31 of the pipe receiver 30. The at least one protrusion 24 will then hold the pipe 14 within the pipe receiver 30.

Figure 8:
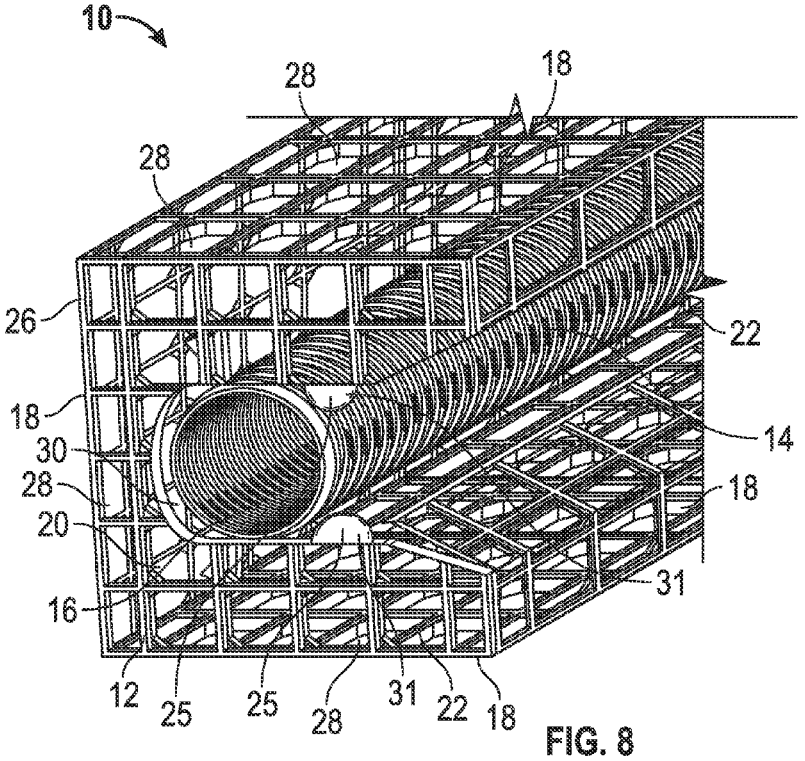
FIG. 8 is an isometric view of an aggregate replacement configured according to a fifth embodiment.

The pipe retainer may also be simply a narrowing of the insertion opening 22 or in an alternate embodiment of the invention as shown in FIG. 8, the pipe retainer may be tabs 25 manufactured at the mouth of a U shaped pipe receiver 30. The tabs 25 along with the U shaped pipe receiver 30 act to hold the pipe 14 in place within the aggregate replacement 10.

Figure 7:
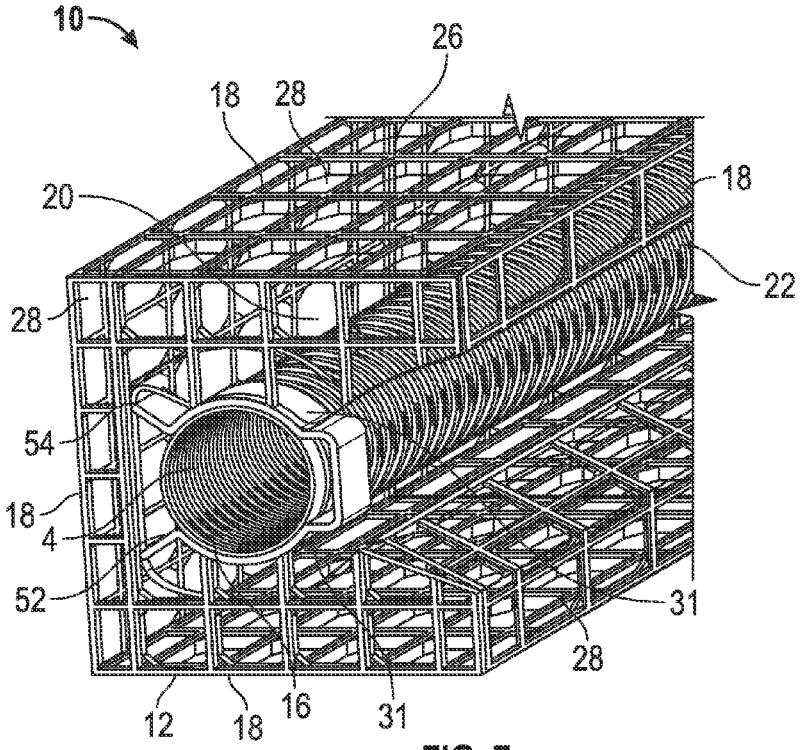
FIG. 7 is an isometric view of an aggregate replacement configured according to a fourth embodiment.

FIG. 7 illustrates an additional embodiment of the aggregate replacement 10, where the pipe retainer uses a pipe clip 52 placed on the pipe 14, prior to the pipe 14 being placed in the insertion opening 22. The pipe clip 52 is then snapped into a pipe clip retainer 54 which is formed into the edge of the pipe receiver 30. The pipe 14 is then held firmly in place in the pipe receiver 30.

Figure 9:
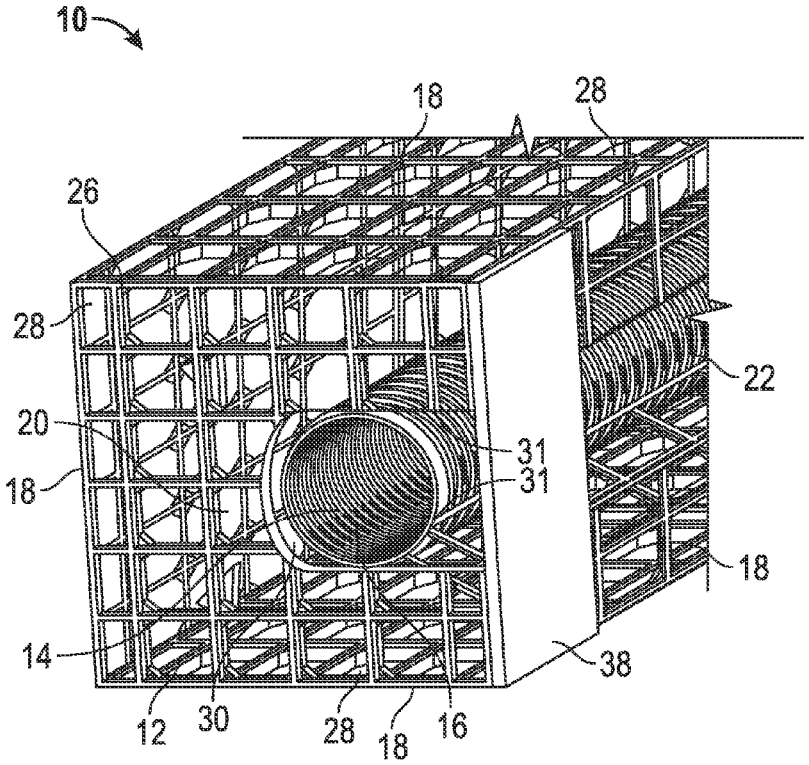
FIG. 9 is an isometric view of an aggregate replacement configured according to a sixth embodiment.

FIG. 9 illustrates yet another embodiment of the pipe retainer. In this embodiment, the pipe 14 is held in the pipe receiver 30 by a strap 38 which is coupled to the structure 26 of the aggregate replacement 10.

Figure 10:
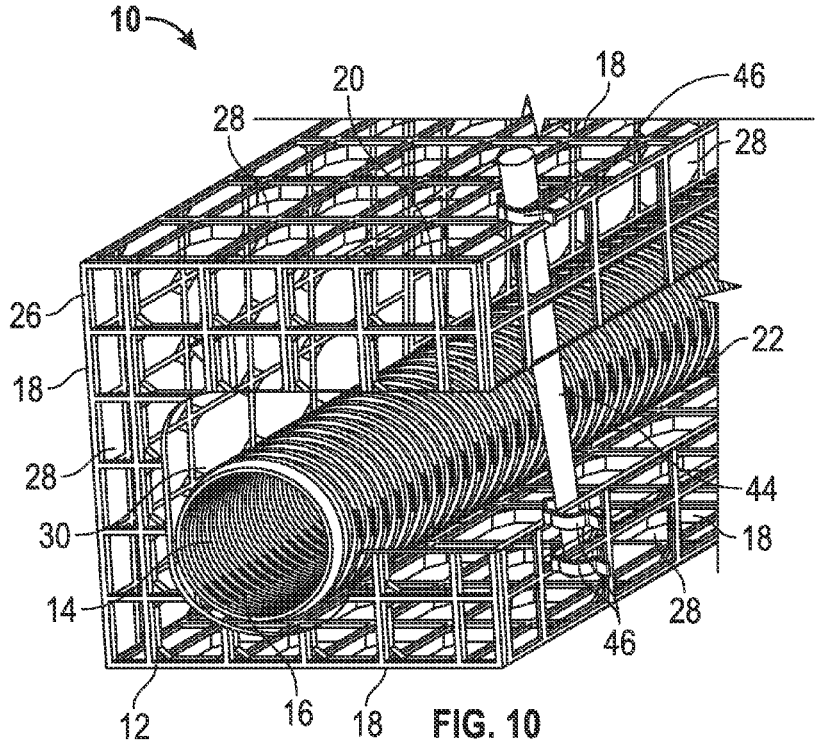
FIG. 10 is an isometric view of an aggregate replacement configured according to a seventh embodiment.

In FIG. 10, the pipe 14 is retained in place in the pipe receiver 30 by gravity. The insertion opening 22 is located slightly above the center of the pipe receiver 30. The pipe 14 passes through the insertion opening 22 and drops into the pipe receiver 30. The pipe 14 then stays in place because it is lower than the insertion opening 22.

FIG. 10 also shows a pipe retainer using a stake 44 which is placed in a stake retainer 46. The stake 44 is simply a metal or wooden stake or rigid rod that is placed inside of an opening called a stake retainer 46. The stake 44 is then usually driven into the ground under the aggregate replacement 10. The stake 44 serves two purposes. First, the stake 44 holds the aggregate replacement 10 in place. Second, the stake 44 prevents the pipe 14 from leaving the pipe receiver 30.

The stake retainer 46 may be a hole in the structure which is designed to have the stake 44 placed in it, as shown in FIG. 10. The stake retainer 46 may also be a strap which straps the stake 44 to the outside of the structure 26. The stake retainer 46 may further be a bolt or screw which bolts or screws the stake 44 to the structure 26. The stake retainer 46 may be any device which couples the stake 44 to the structure 26. Coupling the stake 44 to the structure 26 may include receiving the stake 44 in an opening, physically attaching the stake 44 to the structure 26 or the like.

Figure 6:
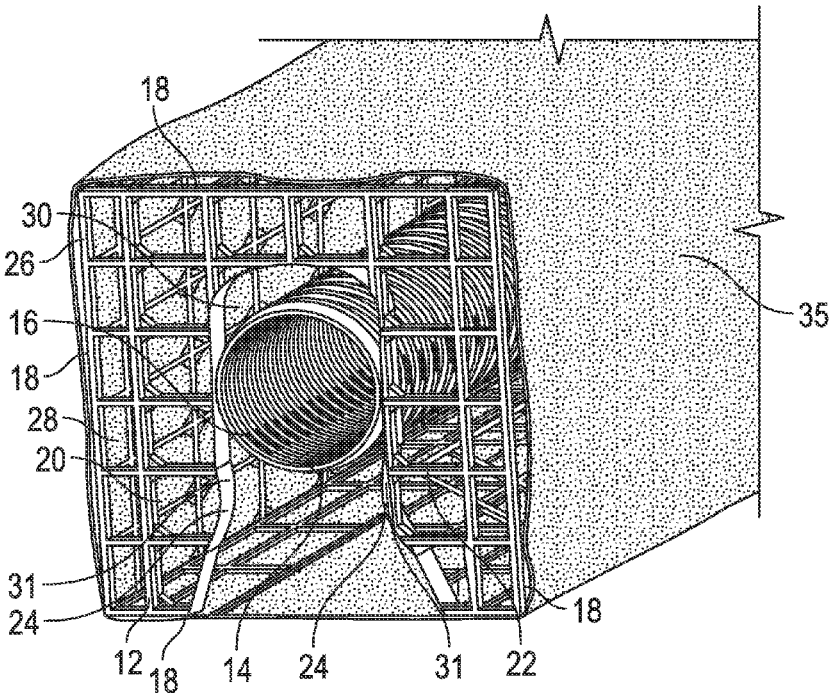
FIG. 6 is an isometric view of an aggregate replacement covered by a liner configured according to a third embodiment.

Once the pipe 14 is inserted into the aggregate replacement 10, the aggregate replacement 10 is either placed in a trench lined with filter fabric or the aggregate replacement 10 is wrapped in filter fabric. FIG. 6 illustrates the aggregate replacement 10 wrapped in filter or landscape fabric 35. The filter or landscape fabric 35 is the same type of fabric used in traditional arrangements of a French drain. The fabric 35 is a water permeable material that prevents soil, rocks, substrates or other things that might clog the perforations 16 in the pipe 14 from entering the aggregate replacement 10.

In using the aggregate replacement 10 embodiments described above, a trench is dug where the drain or distribution system is to be placed. The trench is lined with a water permeable fabric 35 such as landscape fabric, filter fabric, water permeable material or the like. The aggregate replacement 10 is then assembled. If there is more than one unit 36, then the units 36 may be connected together through use of the connectors 34. The pipe 14 is then inserted through the insertion opening 22. The pipe 14 is forced past the protrusions 24 or tabs 25 if protrusions 24 or tabs 25 are being used. The pipe 14 passes through the mouth of the pipe receiver 31 and into the pipe receiver 30. If protrusions 24 or tabs 25 are not being used, then the pipe retainer is now engaged. The aggregate replacement 10 along with the pipe 14 already inserted is then laid on top of the fabric 35 in the trench. Typically, the aggregate replacement 10 will be placed in the trench with the insertion opening 22 positioned towards the bottom of the trench as shown in FIG. 6. This position places the pipe 14 towards the bottom of the trench where more water can flow through the perforations 16 into the pipe 14. The fabric 35 is then wrapped around the aggregate replacement 10 and the trench is filled in.

In alternate embodiments the aggregate replacement 10 may be wrapped in the fabric 35 prior to being placed in the trench.

The pipe 14 could also be inserted into the aggregate replacement 10 after the aggregate replacement 10 is in place in the trench.

When in use, water flows through the fabric 35 and through the openings 28 in the faces 18 of the aggregate replacement 10 structure 26. The water then flows through the perforations 16 into the pipe 14. The pipe 14 will typically be angled so that the water flows down the pipe 14 and to a desired location.

This process works in reverse for other water distribution systems such as those used in residential septic systems.

Figure 12:
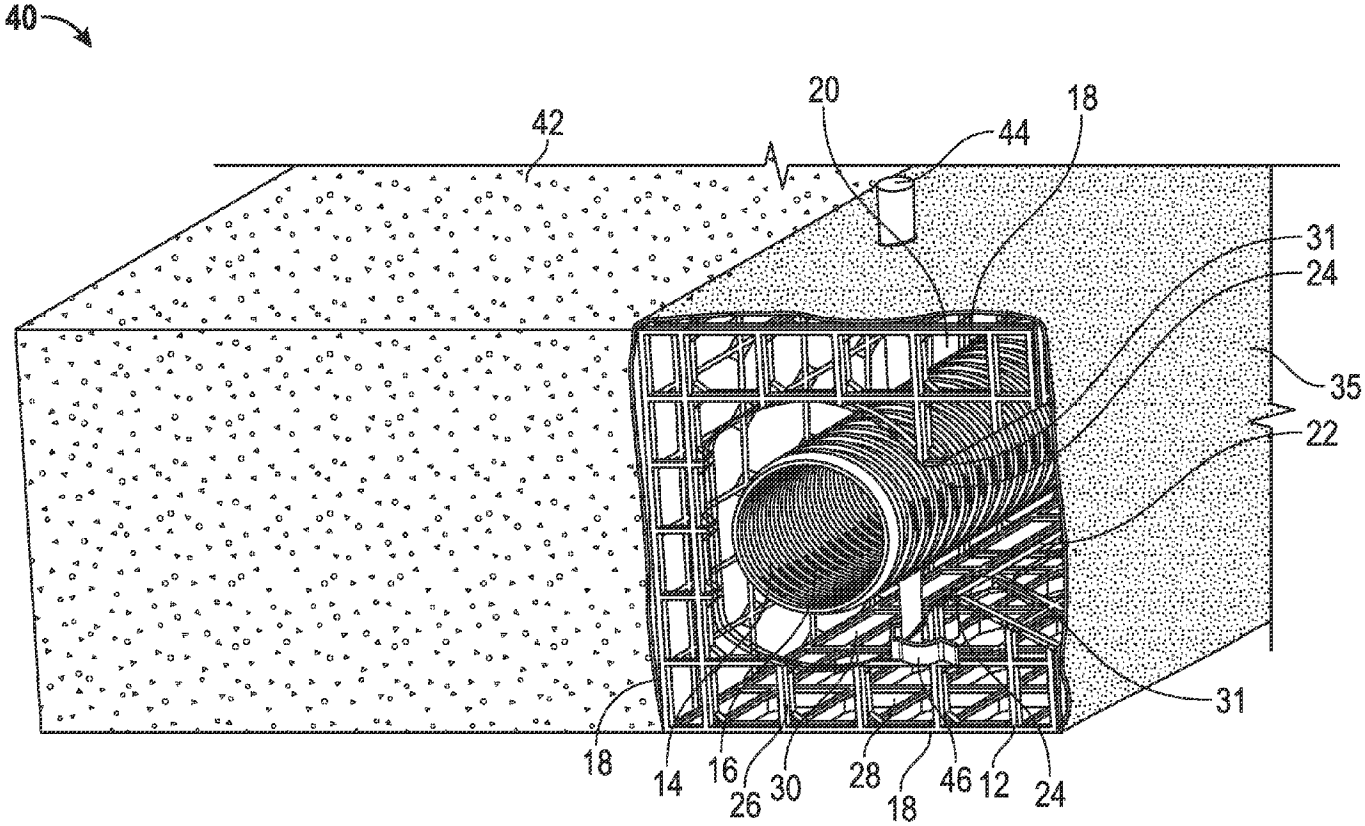
FIG. 12 is an isometric view of an aggregate replacement concrete form configured according to an embodiment.

An additional embodiment of the aggregate replacement is illustrated in FIG. 12. In this embodiment, the aggregate replacement 40 is formed as described above. A stake retainer 46 may also be formed in the structure 26 on the side of the pipe receiver 30 away from the insertion opening 22. The stake 44 in this case will be used only to hold the aggregate replacement 40 in place. In alternate embodiments, a stake retainer 46 may be anything that couples the stake 44 to the structure 26. The aggregate replacement 40 is put in position with the face 18 of the structure 26 opposite the insertion opening 22 acting as a concrete form. The face 18 of the structure 26 opposite the insertion opening 22 is covered with a concrete barrier 35 such as filter fabric, landscape fabric, screen, water permeable material, solid plastic or the like. The concrete barrier 35 may or may not be water permeable. The concrete barrier 35 may be any material that retains the concrete in place while it is curing.

Concrete 42 may then be poured, with the concrete 42 coming up against the water permeable barrier 35. Once the concrete 42 has dried, the pipe 14 may be placed in the aggregate replacement 40 if it has not already been placed.

This arrangement allows moisture to be drained away from the concrete 42. The moisture travels through the material 35, passes through the aggregate replacement 40 and enters the pipe 14 through the perforations 16. The moisture then travels down the pipe 14 and away from the concrete 42.

Accordingly, for the exemplary purposes of this disclosure, the components defining any embodiment of the invention may be formed as one piece if it is possible for the components to still serve their function. The components may also be composed of any of many different types of materials or combinations thereof that can readily be formed into shaped objects provided that the components selected are consistent with the intended mechanical operation of the invention. For example, the components may be formed of rubbers (synthetic and/or natural), glasses, composites such as fiberglass, carbon-fiber and/or other like materials, polymers such as plastic, polycarbonate, PVC plastic, ABS plastic, polystyrene, polypropylene, acrylic, nylon, phenolic, any combination thereof, and/or other like materials, metals, such as zinc, magnesium, titanium, copper, iron, steel, stainless steel, any combination thereof, and/or other like materials, alloys, such as aluminum, and/or other like materials, any other suitable material, and/or any combination thereof.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

The invention claimed is:

1. An aggregate replacement device comprising:

a structure formed as an open scaffolding comprising a proximal end having a face, a distal end having a face, and at least four faces extending between said face of said proximal end and said face of said distal end, wherein said at least four faces further comprises a plurality of first openings;

wherein all of said proximal end having a face, said distal end having a face and said at least four faces are flat;

at least one second opening formed in said proximal end having a face and said distal end having a face;

wherein said at least one second opening further comprises a U shaped cross-section;

wherein said U shaped cross-section of said at least one second opening further comprises at least one protrusion for retaining said at least one pipe in said at least one second opening;

at least one pipe extending transversely through said at least one second opening; and wherein said at least one pipe intersects said proximal end having a face and said distal end having a face at the center of said proximal end having a face and said distal end having a face.

2. The aggregate replacement device of claim 1, further comprising at least one pipe retainer for retaining said at least one pipe in said at least one second opening.

3. The aggregate replacement device of claim 1, further comprising at least one pipe clip and at least one pipe clip retainer.

4. The aggregate replacement device of claim 1, further comprising a coupler for coupling multiple aggregate replacement devices together; wherein said multiple aggregate replacement devices are coupled together with said face of said proximal end of a first one of said multiple aggregate replacement devices abutting said face of said distal end of a second one of said multiple aggregate replacement devices; and wherein said at least one pipe extends continuously through said multiple aggregate replacement devices.

5. The aggregate replacement device of claim 1, further comprising a stake retainer for receiving a stake and wherein said stake fixes the aggregate replacement device in position.

6. The aggregate replacement device of claim 5, wherein a barrier is positioned normal to said at least one face.

7. An aggregate replacement device comprising:

a structure formed as an open scaffolding comprising a proximal end, a distal end, and at least one flat face wherein said at least one flat face is permeable to water;

an opening bisecting said at least one flat face, wherein said opening extends from said proximal end to said distal end continuously;

wherein said opening is configured to receive at least one pipe inserted in a radial direction of said at least one pipe;

wherein said opening further comprises at least one pipe retainer; and wherein said at least one pipe retainer further comprises at least one pipe clip coupled to said at least one pipe and at least one pipe clip receiver, wherein said at least one pipe clip is received by said at least one pipe clip receiver.

8. The aggregate replacement device of claim 7, wherein one said at least one pipe retainer is formed in said proximal end and one said at least one pipe retainer is formed in said distal end of said structure.

9. The aggregate replacement device of claim 7, wherein said at least one pipe retainer further comprises a U shaped opening with at least one protrusion extending inward in said U shaped opening.

10. The aggregate replacement device of claim 7, wherein said at least one pipe retainer further comprises a semicircular chamber sized to hold said at least one pipe, wherein said semicircular chamber is communicatively connected to said opening and wherein said opening is narrower than a diameter of said at least one pipe.

11. An aggregate replacement device comprising:

a structure comprising a proximal end having a face, a distal end having a face, and at least four flat faces extending between said face of said proximal end and said face of said distal end, wherein said at least four flat faces further comprise a plurality of first openings and each face of the said at least four flat faces are transverse to an adjacent face of the at least four flat faces;

a stake coupled to said structure, wherein said stake secures said structure in position;

a barrier abutting at least one of said at least four flat faces;

at least two second openings in said structure, wherein one of said at least two second openings is in said face of said proximal end of said structure and one of said at least two second openings is in said face of said distal end of said structure;

wherein said at least two second openings are configured to receive at least one pipe;

at least one pipe retainer for retaining said at least one pipe in said at least two second openings; and wherein said at least one pipe retainer further comprises a semicircular chamber sized to hold said at least one pipe, wherein said semicircular chamber is communicatively connected to said at least two second openings.

12. The aggregate replacement device of claim 11, wherein said stake is coupled to said structure by a stake retainer.

13. The aggregate replacement device of claim 11, further comprising at least one coupler for coupling multiple aggregate replacement devices together, wherein said face of said distal end of a first of said multiple aggregate replacement devices abuts said face of said proximal end of a second of said multiple aggregate replacement devices when said multiple aggregate replacement devices are coupled together.

14. The aggregate replacement device of claim 11, wherein said at least two second openings further comprise a U shaped opening with at least one protrusion extending inward in said U shaped opening.

15. The aggregate replacement device of claim 11, wherein said aggregate replacement device may be used as a form for concrete.

* * * * *